US008230652B2

(12) United States Patent
An

(10) Patent No.: US 8,230,652 B2
(45) Date of Patent: Jul. 31, 2012

(54) REINFORCED MULL POST ASSEMBLY

(75) Inventor: Pao Yu An, Tustin, CA (US)

(73) Assignee: Plastpro 2000, Inc., Los Angeles, CA (US)

( * ) Notice: Subject to any disclaimer, the term of this patent is extended or adjusted under 35 U.S.C. 154(b) by 181 days.

(21) Appl. No.: 12/693,552

(22) Filed: Jan. 26, 2010

(65) Prior Publication Data

US 2010/0192489 A1 Aug. 5, 2010

Related U.S. Application Data

(60) Provisional application No. 61/148,652, filed on Jan. 30, 2009.

(51) Int. Cl.
*E06B 1/04* (2006.01)
*E04C 1/00* (2006.01)

(52) U.S. Cl. ..... 52/210; 52/309.7; 52/309.16; 52/204.1

(58) Field of Classification Search ..... 52/210, 52/309.15, 204.1, 656.4, 211, 212, 204.2, 52/656.2, 656.5, 716.8, 717.01, 717.02, 455–458, 52/847, 309.7, 309.16
See application file for complete search history.

(56) References Cited

U.S. PATENT DOCUMENTS 4,341,831 A 7/1982 Kleiss
4,717,185 A * 1/1988 Hartley ..... 292/340
4,858,384 A * 8/1989 Blankenship ..... 49/460
5,435,106 A 7/1995 Garries et al.
5,566,509 A * 10/1996 Long ..... 49/462
5,579,618 A * 12/1996 Riegelman ..... 52/309.16
5,634,306 A * 6/1997 Riegelman ..... 52/309.16
5,832,681 A * 11/1998 Johnson ..... 52/210
5,836,628 A * 11/1998 Beier ..... 292/346
5,848,505 A 12/1998 Taylor
6,003,277 A 12/1999 Graham et al.
6,148,582 A 11/2000 Ellingson
6,161,361 A * 12/2000 Ehrenkrantz ..... 52/847
6,598,350 B1 * 7/2003 Suter ..... 49/506
7,467,818 B2 * 12/2008 Young ..... 292/341.14
7,543,416 B2 * 6/2009 Albertelli ..... 52/455
7,543,864 B2 * 6/2009 Barthel ..... 292/340
2002/0174610 A1 11/2002 Bennett et al.
2006/0267238 A1 * 11/2006 Wang ..... 264/122
2012/0073240 A1 * 3/2012 An et al. ..... 52/844

* cited by examiner

*Primary Examiner* — Mark Wendell
(74) *Attorney, Agent, or Firm* — Duane Morris LLP

(57) ABSTRACT

A composite reinforced mull post is disclosed or use in an exterior building entryway assembly, engaging a door on one side and a side light window on the other side. The mull post may comprise a polymer profile portion and first and second reinforcing members. The profile portion comprises a layer of polyvinyl chloride with a hollow center. The first reinforcing member comprises an engineered material such as a wood laminate, and the second reinforcing member comprises a U-shaped steel channel that fits around one end of the first reinforcing member. The reinforcing members are received within the hollow center of the polymer profile portion and run the entire length of the mull post to provide substantial rigidity to the assembly. A polymer cap layer may be co-extruded on the outer surface of the polymer profile portion to provide the mull post with a desired finished surface appearance and/or color.

19 Claims, 4 Drawing Sheets

REINFORCED MULL POST ASSEMBLY

CROSS-REFERENCE TO RELATED APPLICATIONS

This is a non-provisional of co-pending U.S. provisional patent application Ser. No. 61/148,652, filed Jan. 30, 2009, the entirety of which application is incorporated by reference herein.

FIELD OF THE INVENTION

The disclosure relates generally to mull posts for use in exterior door assemblies, and more particularly to a reinforced composite mull post for use in an exterior door assembly.

BACKGROUND OF THE INVENTION

Entryway systems used in residential and commercial buildings include single and double door assemblies having one or more sidelights or sidelight panels flanking the door(s). Such entryway systems are typically fabricated using vertical mullions or mull posts positioned between the door(s) and the associated sidelight or sidelight panel to connect the structures. When these entryway systems are used in coastal regions of the country, it is desirable that the systems be capable of withstanding the extremely high pressures caused by high winds as well as impacts caused by flying debris.

Traditionally, mull posts have been fabricated from wood, such as pine, small pieces of which are finger jointed end to end and milled to form the mull profile. While such construction is acceptable in many regions, it generally does not result in mull posts that can withstand the extreme weather conditions that often occur in coastal areas. For instance, when an entryway having traditional wood mull posts is exposed to the high pressures from wind forces that entryways in coastal areas may experience, the forces transferred through the door to the mull posts can cause the mulls, and thus the entryway, to fail. Often the mulls break apart at the finger joints that are used to join the small segments of mull together. Even where the finger joints hold, the wood of the mulls can split apart along the grain at the locations of door hardware such as the strike plate, deadbolt strike, and hinges. Further, the high pressure can cause the mulls to deflect or bend, compromising the integrity of hardware fasteners. Thus, traditional finger jointed wood mull posts are not acceptable for use in regions with stringent design pressure requirements. Even where solid wood mull designs are used to eliminate failure at finger joint locations, problems caused by splitting of the wood along its grain remain.

More recently, extruded polymer mull posts made from inexpensive materials such as polyvinyl chloride (PVC) have been used. While polymer mull posts may not be as susceptible to breaking or splitting like traditional wood mulls, they still may be highly susceptible to deflection or bending when exposed to high pressure, thus compromising the integrity of the entryway system as previously explained.

In addition to the high design pressure requirements in hurricane prone regions, building codes in coastal regions also typically require that an entryway withstand a direct impact by airborne debris such as tree limbs. Traditional solid wood mull posts and extruded polymer mulls may be highly vulnerable to such impacts, again, for the reasons previously stated.

Thus, a need exists for an entryway system incorporating high strength mull posts that meet or exceed design requirements imposed by stringent building codes in coastal regions. Such mull posts should be inexpensive to produce, and should emulate the appearance of traditional wooden mulls so that they are acceptable for use in private residences.

SUMMARY OF THE INVENTION

A reinforced mull post is disclosed. The reinforced mull post may comprise a mull post profile comprising an elongated support portion and a stop portion. The support portion may have first and second support faces, and the stop portion may have first and second legs forming first and second raised stops laterally offset from said first and second support faces, respectively. The mull profile may further comprise a hollow central chamber extending within the support portion and the stop portion. The mull profile may have a first reinforcing member disposed within the hollow central chamber; and a second reinforcing member disposed within the hollow central chamber in cooperation with the first reinforcing member. The second reinforcing member may be made from a material that is different from that of the first reinforcing member. The first and second reinforcing members may enhance a structural strength and a rigidity of the mull post profile.

A reinforced mull post is further disclosed, comprising an extruded mull post profile having an elongated support portion and a stop portion. The support portion may have first and second support faces, and the stop portion may have first and second legs forming first and second raised stops laterally offset from said first and second support faces, respectively. A first reinforcing member may be disposed within a hollow central chamber of the extruded mull post profile. A second reinforcing member may be disposed within the hollow central chamber. The second reinforcing member may comprise a material different from that of the first reinforcing member. The first and second reinforcing members may enhance at least one of a structural strength and a rigidity of the mull post profile.

A reinforced mull post assembly is disclosed, comprising a polymer mull post having an elongated support portion and a stop portion. The support portion may have first and second support faces, and the stop portion may have first and second legs forming first and second raised stops laterally offset from said first and second support faces by first and second slots, respectively. A first reinforcing member may be disposed within a hollow central chamber of said polymer mull post. The first reinforcing member enhances at least one of a structural strength and a rigidity of the mull post.

BRIEF DESCRIPTION OF THE DRAWINGS

The accompanying drawings illustrate preferred embodiments of the invention so far devised for the practical application of the principles thereof, and in which.

DETAILED DESCRIPTION

Figure 1:
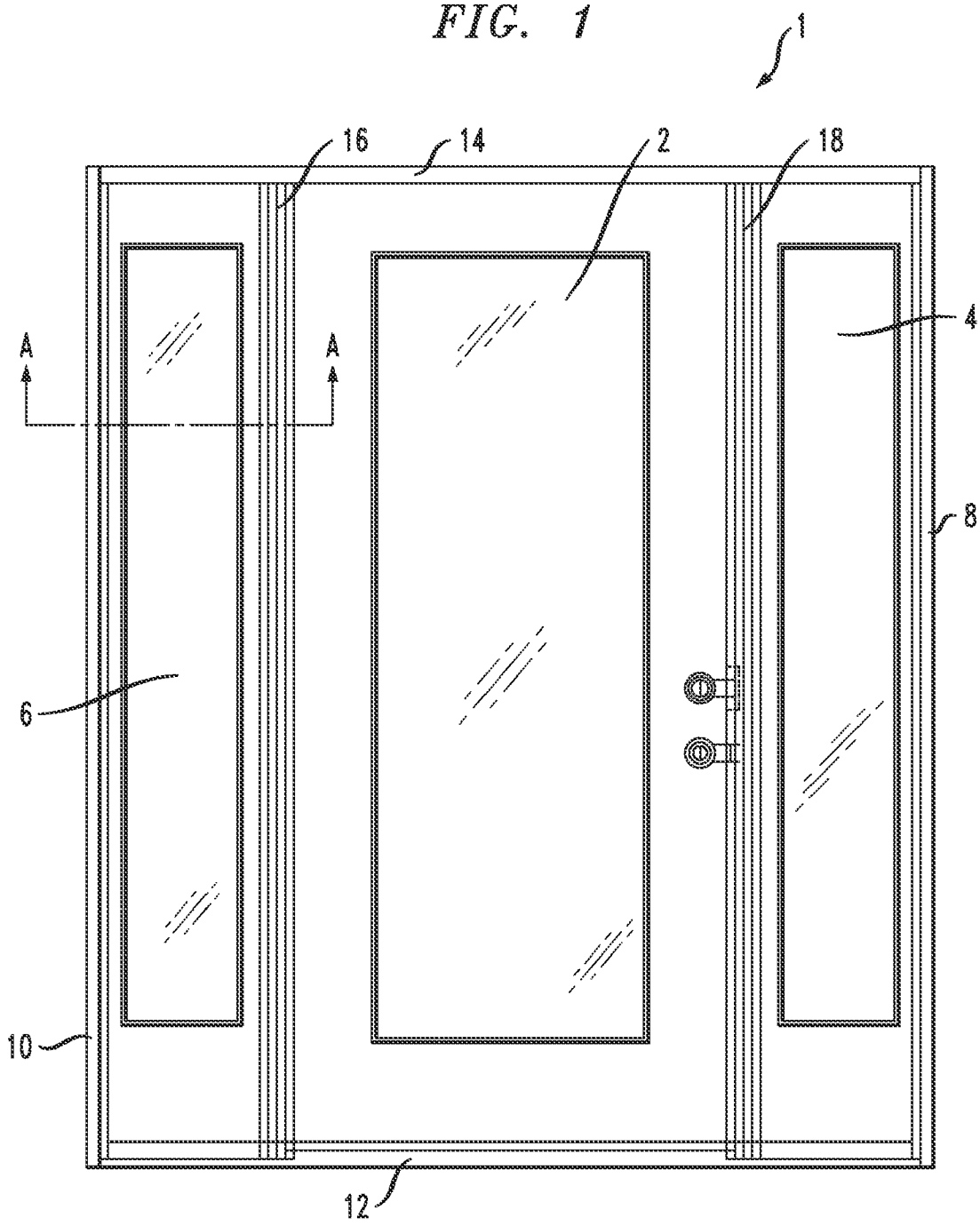
FIG. 1 is an elevation view of a door assembly incorporating the inventive mull post design.

Referring to FIG. 1, a typical exterior door assembly 1 comprises a central hinged door 2 and side light window panels 4, 6 that flank the door on either side. The exterior door assembly 1 further comprises a pair of vertical door jambs 8, 10 that extend between a sill 12 and a header 14. Together, the jambs 8, 10, the sill 12 and header 14 define the outer peripheral frame of the exterior door assembly 1. A pair of spaced mull posts 16, 18 extend vertically between the sill 12 and the header 14 and define a central opening in which the hinged door 2 is disposed, as well as two flanking side openings on either side of the door for receiving the side light window panels 4, 6.

Figure 2:
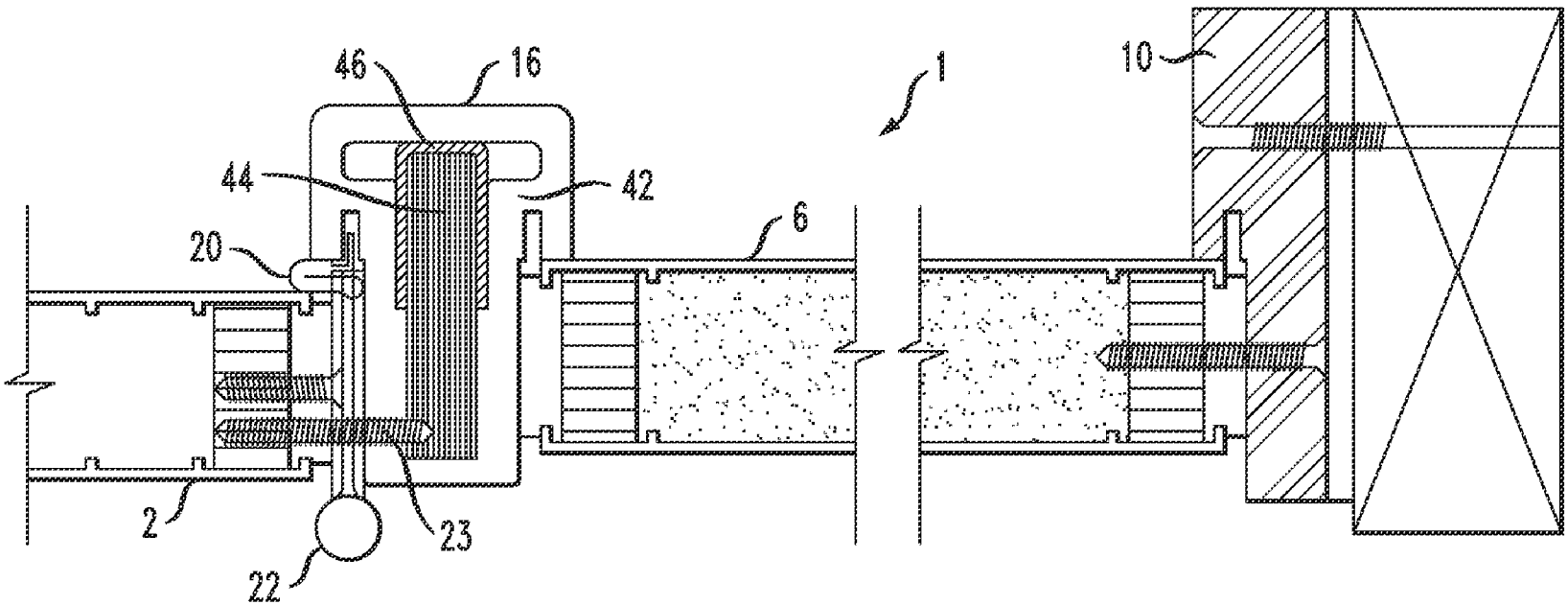
FIG. 2 is a cross section view of the door assembly of FIG. 1 taken along line A-A.

Referring to FIG. 2, a partial cross-section of the door assembly 1 is shown. As can be seen, the left-most mull post 16 is positioned between the left-most side light window panel 6 and the door 2. A piece of weather-stripping 20 is engaged between the mull post 16 and the door 2, and a door hinge 22 is shown fixing the door 2 to the mull post 16 by way of traditional threaded fasteners 23. Thus, the mull post 16 serves to provide both horizontal and lateral sealing of the door 2 and side light window panel 6.

Figure 3:
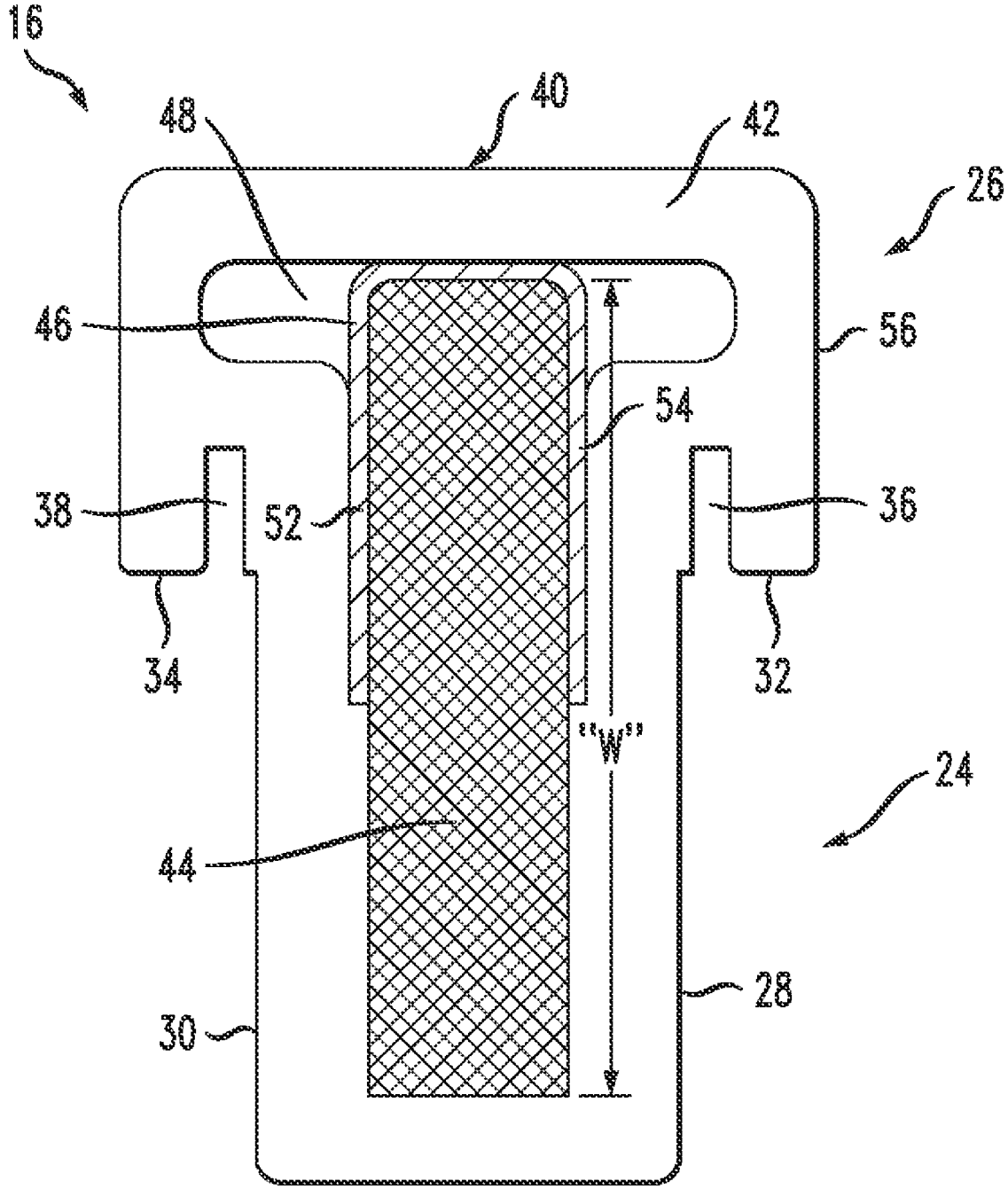
FIG. 3 is a cross section view of the inventive mull post design of FIGS. 1 and 2.

Referring now to FIG. 3, a cross-section of the disclosed mull post 16 is shown. Although the description will proceed with reference to mull post 16, it will be appreciated that the identical description also applies to mull post 18. The mull post 16 has a support portion 24 and a stop portion 26. The support portion 24 comprises first and second support faces 28, 30 for engaging respective end surfaces of the side light panel 6 and door 2 to provide a desired lateral offset between the two. The stop portion 26 comprises first and second raised stops 32, 34 for engaging respective side surfaces of the side light panel 6 and door 2 to provide a desired horizontal positioning of each within the door assembly 1. Defined within each of the first and second raised stops 32, 34 is a longitudinal slot 36, 38 that extends along the length of the vertical mull post 16. These longitudinal slots 36, 38 are sized and shaped to receive weather stripping 20 and/or a tab fixture (FIG. 2) for engaging and sealing the door 2 and side light 6 to the mull post 16.

The stop portion 26 of the mull post 16 may further have an exposed face portion 40 that extends along the length of the mull post 16 and is exposed to the exterior of the building in which the door assembly 1 is installed. In the illustrated embodiment, this exposed face portion 40 is flat, however, it will be appreciated that a the face portion may be provided in any of a variety of different decorative shapes to result in a desired external appearance for the mull post 16. This exposed face portion 16 may have a surface that can be painted or otherwise finished in any manner to provide the appearance of a traditional wood mullion.

While the external appearance of the mull post 16 provides the look of a single-piece construction, the interior of the mull post is made up of multiple components that reinforce the mull post and provide a desired high degree of strength and rigidity. Thus, the mull post 16 may comprise an outer polymer profile portion 42 with first and second reinforcing members 44, 46 sandwiched within. The polymer profile portion 42 incorporates the external physical features as previously described. It also comprises a hollow center 48 sized and shaped to receive the first and second reinforcing members 44, 46.

In one embodiment, the polymer profile portion 42 is fabricated from a thermoplastic material, such as polyvinyl chloride (PVC), and is formed using an extrusion process, although other formation processes such as molding may also be used. The first reinforcing member 44 may comprise engineered wood, such as laminated veneer lumber (LVL). The second reinforcing member 46 may comprise a steel U-channel that wraps around one end of the first reinforcing member 44 to further enhance the strength and rigidity of the resulting mull post 16.

The material of the polymer profile portion 42 may be any of a variety of thermosetting polymers, a non-limiting list of which includes PVC, PE (Polyethylene), PP(Polypropylene), ABS (Acrylonitrile Butadiene Styrene), PC(Polycarbonate), PS(Polystyrene), NYLON and TEFLON. The hollow center 48 may be formed during the extrusion process (where an extrusion process is used), or it may be formed after the profile portion is formed (e.g., by machining from of a solid formed profile).

Figure 4:
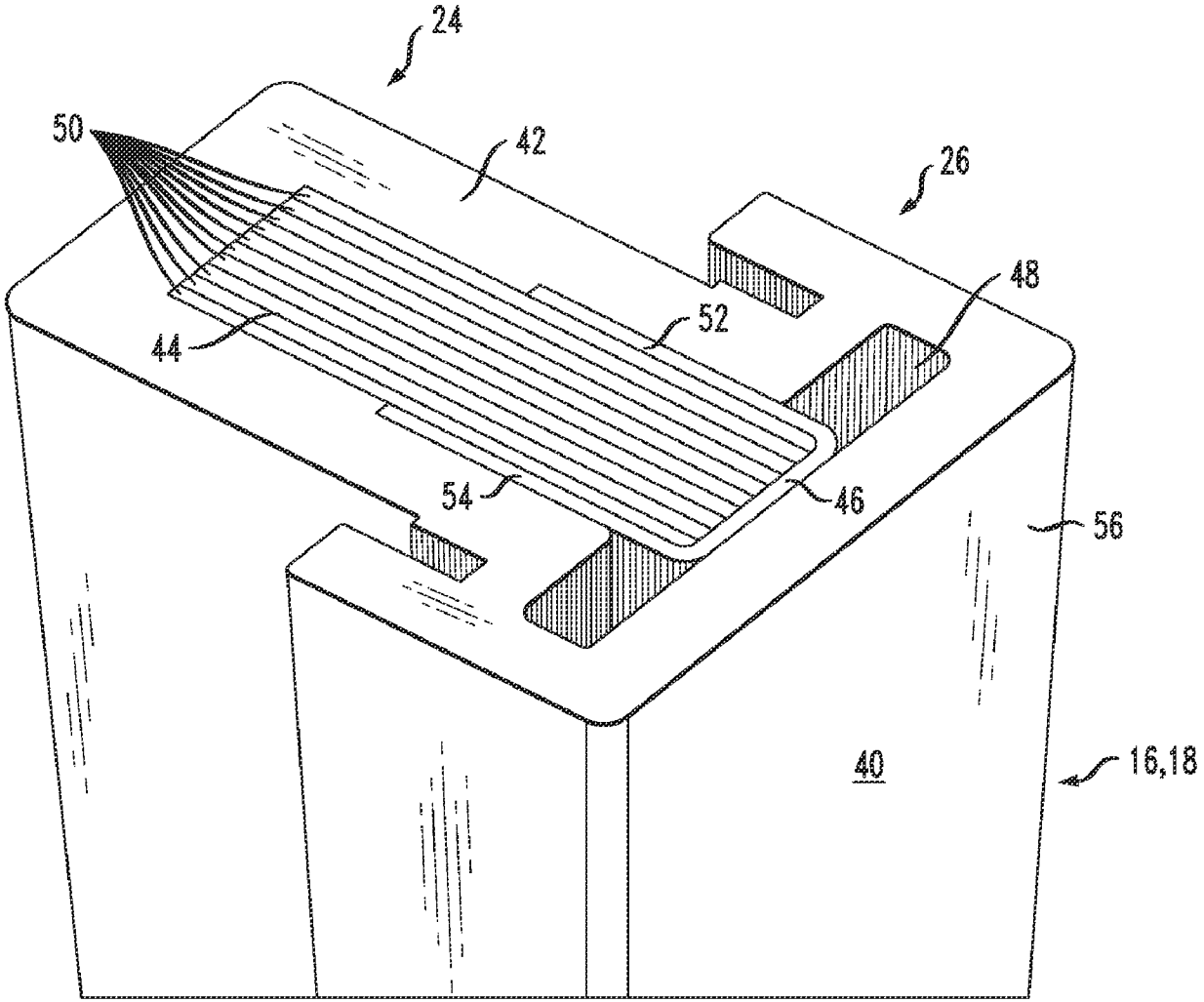
FIG. 4 is a cutaway perspective view of the inventive mull post design of FIGS. 1 and 2.

The first reinforcing member 44 may comprise a sold piece of wood or other material (e.g., a second polymer), or it may comprise plurality of individual plies 50 of material glued or otherwise adhered together to form a multiple ply structure (see FIG. 4). As will be appreciated, the material and structure of the plies 50 may be varied depending upon the ultimate use and desired strength of the mull post 16. For instance, the first reinforcing member 44 may be a traditional engineered lumber product such as LVL, which uses multiple layers of thin wood assembled with adhesive. LVL offers several advantages over solid wood in that it is stronger, straighter, and more uniform. It is also much less likely than conventional lumber to warp, twist, bow, or shrink due to its composite nature. Another appropriate engineered material for use as the first reinforcing member 44 is parallel strand lumber (PSL), which is manufactured from large flakes of wood. Where LVL is used, the types of wood used to form the veneers of the plies 50 may vary and the plies may be oriented such that their grains extend in different directions to enhance the strength of the member. Various types of LVL and PSL are available from vendors of engineered lumber and are well known by those of skill in the art.

As an alternative to LVL or PVL, the first reinforcing member 44 may be formed from plies 50 made of a mixture of wood and other materials to enhance the strength of the member. For example, some of the plies 50 may be wood veneers while other plies may be plastic, carbon composite, fiberglass, or metal such as aluminum. The use of such non-wooden plies combined with wooden plies may form a first reinforcing member 44 of exceptional strength and resistance to failure under even the most severe load conditions.

As noted, the second reinforcing member 46 may comprise a steel U-channel that wraps around one end of the first reinforcing member 44. In the illustrated embodiment, the second reinforcing member 46 is positioned so that it wraps around the first reinforcing member 44 at the end immediately adjacent the stop portion 26 of the mull post 16 to provide support to the exposed face portion 40, and to provide the mull post with maximum rigidity against flexure in use. As can be seen, the second reinforcing member 42 does not extend the entire width "W" (FIG. 3) of the first reinforcing member 44. This ensures that fasteners (such as for attaching hinges or other connecting hardware) can be easily screwed through the support portion 24 of the mull post 16 and into the first reinforcing member 44. In the illustrated embodiment, the leg portions 52, 54 of the second reinforcing member 46 extend approximately one half the width "W" of the first reinforcing member 44. Depending on the application, the leg portions 52, 54 may extend over greater or lesser percentages of the width "W" of the first reinforcing member 44.

As will be appreciated, the second reinforcing member 46 may be provided in shapes other than the U-shape illustrated in the figures. For example, the second reinforcing member 46 could simply comprise a flat metal member positioned on one broad flat side of the first reinforcing member 44, running the entire length of the mull post 16. Alternatively, a pair of flat metal members could be positioned on opposite broad sides of the first reinforcing member 44. In addition, any of a variety of metals can be used, a non-limiting list of which includes aluminum, steel, stainless steel and copper. Further, highly-rigid non-metals such as fiberglass, graphite reinforced polymers, and the like could also be used to form the second reinforcing member 46.

In addition, it will be appreciated that the mull post 16 may be provided with a profile portion 42 and only a single reinforcing member. Thus, in one embodiment the mull post 16 may comprise the profile portion 42 and only the first reinforcing member 44. In another alternative embodiment the mull post 16 may comprise the profile portion 42 and only the second reinforcing member 46.

Where the polymer profile portion 42 is formed by an extrusion process, a cap stock layer 56 may be co-extruded onto the profile portion 42 to provide protection to the profile portion 42 to increase weatherability (e.g., resist UV rays), and to provide a desired finished exterior appearance and/or color to the mull post 16. This cap stock layer 56 may comprise PVC, and may be provided in a thickness range of about 0.4 to about 0.6 millimeters. In one embodiment, the cap stock layer 56 is applied in a thickness of about 0.6 millimeters.

As discussed above, with prior solid wood or finger jointed wood mullions, the attachment points of the hinges to the mullion tend to be regions of failure under extreme wind induced pressures on the door. With the disclosed reinforce mull post, however, the screws that attach the hinges (and other door hardware) to the mull post extend deeply into the multiple plies of the first reinforcing member 44. Since the grains of the plies 50 can be oriented in various directions, the tendency for inward force at the locations of the hinges to split the mullion along its length is minimized. Furthermore, threading screws into a multiply material such as LVL is expected to form a far stronger attachment as compared to treading screws into the solid pine of traditional mullions. Accordingly, the screws will not be pulled out of the: mull post under the stress of extreme pressure induced forces. This is expected to be even more true where the truss may include plies of non-wooden materials such as plastic or metal.

Although the inventive design has been disclosed for use in mull post applications, it may also be used to advantage to form the vertical door jambs 8, 10, sills 12 and headers 14 of the door assembly 1. Often, however, only the mull posts 16 are formed using the disclosed reinforced design because the strength of the jambs, sills and headers is not as critical as that of the mull posts since the jambs, sills and header are typically secured directly to the heavy construction framing of the opening into which the door assembly installed. As such, forces imparted to the jambs are typically transferred directly to the framing timbers and splitting and failure of the jambs generally is less a problem that failure of the otherwise unsupported mullion members.

The disclosed mull posts 16, 18 may be attached at their top and bottom ends with screws or other appropriate fasteners to the sill 12 and header, respectively.

With the disclosed door assembly 1 installed in a dwelling that is subjected to the high winds of a hurricane or other storm, the door and panels can be subjected to extreme pressures and consequently extreme inwardly directed forces. These forces are transferred from the door and panels to the reinforced mull posts of the entryway, which, due to their reinforced construction, resist the failure modes common for traditional mull posts and transom mulls. Ultimately, much of the force born by the mull posts 16, 18 are transferred to the vertical jambs 8, 10, the sill 12 and the header 14, and, in turn, to the framing timbers of the building.

It should be understood that the embodiments disclosed herein are merely illustrative of the principles of the invention. Various other modifications may be made by those skilled in the art which will embody the principles of the invention and fall within the spirit and the scope thereof. For instance, the inventive reinforced mull posts may be used in window frames as well as entryways and may be applied to entryways with a transom and a single sidelight. Application to entryways of other configurations also is envisioned.

What is claimed is:

1. A reinforced mull post, comprising:

a unitary mull post profile comprising an elongated support portion and a stop portion, the support portion having first and second support faces, and the stop portion having first and second legs forming first and second raised stops laterally offset from said first and second support faces, respectively, the mull profile further comprising a hollow central chamber extending within the support portion and the stop portion;

a first reinforcing member disposed within the hollow central chamber; and a second reinforcing member disposed within the hollow central chamber and positioned such that the second reinforcing member wraps around a portion of the first reinforcing member within the stop portion of the mull post profile, the second reinforcing member including first and second legs and being made from a material that is different from that of the first reinforcing member, the first and second legs of the second reinforcing member extending along respective exterior surfaces of the first reinforcing member and having width dimensions that are less than a width dimension of the first reinforcing member;

wherein the first and second reinforcing members enhance a structural strength and a rigidity of the mull post profile.

2. The reinforced mull post of claim 1, wherein the mull post profile comprises extruded polyvinyl chloride (PVC).

3. The reinforced mull post of claim 1, wherein the first reinforcing member comprises an engineered wood material.

4. The reinforced mull post of claim 3, wherein the first reinforcing member comprises laminated veneer lumber.

5. The reinforced mull post of claim 1, wherein the second reinforcing member comprises a U-shape.

6. The reinforced mull post of claim 1, wherein the first and second legs of the second reinforcing member extend over 50% of the width of the first reinforcing member.

7. The reinforced mull post of claim 5, wherein the second reinforcing member comprises steel.

8. The reinforced mull post of claim 1, further comprises a cap stock layer disposed over at least a portion of an external surface of the mull post profile.

9. The reinforced mull post of claim 1, wherein the first and second raised stops are laterally offset from said first and second support faces by respective slots configured to receive a tab member of an adjacent structure or a length of weather stripping for sealing the mull post to adjacent structure.

10. A reinforced mull post, comprising:

an extruded unitary mull post profile having an elongated support portion and a stop portion, the support portion having first and second support faces, and the stop portion having first and second legs forming first and second raised stops laterally offset from said first and second support faces, respectively;

a first reinforcing member disposed within a hollow central chamber of said extruded unitary mull post profile; and a second reinforcing member disposed within the hollow central chamber and positioned such that the second reinforcing member wraps around a portion of the first reinforcing member within the stop portion of the mull post profile, the second reinforcing member including first and second legs and comprising a material different from that of the first reinforcing member, the first and second legs of the second reinforcing member extending along respective exterior surfaces of the first reinforcing member and having width dimensions that are less than a width dimension of the first reinforcing member;

wherein the first and second reinforcing members enhance at least one of a structural strength and a rigidity of the mull post profile.

11. The door assembly of claim 10, wherein the mull post profile comprises polyvinyl chloride (PVC).

12. The reinforced mull post of claim 10, wherein the first reinforcing member comprises an engineered wood material and the second reinforcing member comprises a U-shape.

13. The reinforced mull post of claim 12, wherein the first reinforcing member comprises laminated veneer lumber.

14. The reinforced mull post of claim 10, wherein the first reinforcing member comprises laminated veneer lumber and the second reinforcing member comprises steel.

15. The reinforced mull post of claim 10, further comprises a cap stock layer disposed over at least a portion of an external surface of the mull post profile.

16. A reinforced mull post assembly, comprising:

a unitary polymer mull post having an elongated support portion and a stop portion, the support portion having first and second support faces, and the stop portion having first and second legs forming first and second raised stops laterally offset from said first and second support faces by first and second slots, respectively;

a first reinforcing member disposed within a hollow central chamber of said polymer mull post, the first reinforcing member having a first width dimension and including a plurality of plies; and a second reinforcing member having a U-shape including first and second legs, the second reinforcing member disposed within the hollow central chamber of the polymer mull post and wrapping around a portion of the first reinforcing member, the first and second legs of the second reinforcing member extending along respective exterior surfaces of the first reinforcing member, each of the first and second legs of the second reinforcing member having a respective width dimension that is less than the width dimension of the first reinforcing member such that the first and second legs extend along at least a portion of the first reinforcing member that is disposed within the stop portion of the polymer mull post, wherein the first and second reinforcing members enhance at least one of a structural strength and a rigidity of the polymer mull post.

17. The reinforced mull post assembly of claim 16, wherein the polymer mull post comprises extruded polyvinyl chloride and the first reinforcing member comprises laminated veneer lumber.

18. The reinforced mull post assembly of claim 16, wherein the polymer mull post comprises extruded polyvinyl chloride, the first reinforcing member comprises laminated veneer lumber, and the second reinforcing member comprises steel.

19. The reinforced mull post assembly of claim 16, further comprising a polymer cap layer disposed over an exterior surface of the polymer mull post.

* * * * *